United States Patent [19]

Lisiecki

[11] Patent Number: 5,025,982

[45] Date of Patent: Jun. 25, 1991

[54] MULTI-PIECE FLAT TOP CONTAINER

[75] Inventor: Robert E. Lisiecki, W. Bloomfield, Mich.

[73] Assignee: Elopak Systems, A.G., Glattbrugg, Switzerland

[21] Appl. No.: 604,130

[22] Filed: Oct. 29, 1990

[51] Int. Cl.[5] ..... B65D 5/46

[52] U.S. Cl. ..... 229/125.35; 220/258; 220/359; 229/125.13

[58] Field of Search ..... 229/125.35, 125.13, 229/199; 220/258, 359, 640

[56] References Cited

U.S. PATENT DOCUMENTS

| | | | |
|---|---|---|---|
| 3,659,774 | 5/1972 | Mielke | 229/199 |
| 4,101,047 | 7/1978 | Geppert et al. | 229/125.35 |
| 4,305,535 | 12/1981 | Brundige et al. | 229/5.7 |
| 4,328,905 | 5/1982 | Hardt | 220/258 |
| 4,442,971 | 4/1984 | Helms | 229/125.35 |
| 4,444,355 | 4/1984 | Cary | 229/125.13 |
| 4,448,345 | 5/1984 | Helms | 229/125.35 |
| 4,560,063 | 12/1985 | Müller | 229/5.7 |
| 4,856,674 | 8/1989 | Berney | 220/258 |

*Primary Examiner*—Stephen Marcus
*Assistant Examiner*—Christopher McDonald
*Attorney, Agent, or Firm*—John P. Moran

[57] ABSTRACT

A multi-piece flat top container including a thermoplastic coated paperboard body of a predetermined cross-sectional configuration, a thermoplastic adapter ring having an annular recess formed therein for mounting over the top edge of the body and fusion sealed thereto, and a tamper-evident flat membrane or any suitable material sealed adjacent its peripheral edge to the top edge of the adapter ring. An optional over-cap may be mounted over the membrane and adapter ring without being sealed thereto.

6 Claims, 3 Drawing Sheets

MULTI-PIECE FLAT TOP CONTAINER

TECHNICAL FIELD

This invention relates generally to containers and more particularly, to sealed multi-piece flat top containers for spoonable food products.

BACKGROUND ART

Heretofore, there have been a multiplicity of multi-piece flat top containers. For example:

Scanga et al U.S. Pat. No. 4,094,460 discloses the broad idea of placing a sealing ring about the top of a container, with a foil membrane secured to the top surface of the ring by a peelable coating and permanently secured to the undersurface of an overcap. The sealing ring is heat sealed to an inner foil layer of the container.

Rutkowski U.S. Pat. No. 2,257,919 includes a sheet metal ring having an inner wall portion, an outer wall portion, with an intermediate pocket for mounting on the top edge of a container. A sheet metal closure or cover is adapted to mount on the upper edge seat of the ring, confining an optional packing disk therebetween.

Whitney U.S. Pat. No. 3,445,024 discloses a flexible sealing ring or gasket adapted to engage the top beaded edge of a glass container to seal same when covered by a cover member.

Strouse et al U.S. Pat. No. 3,396,899 includes a liner comprising a panel spanning the mouth of a container, with an annular flange having an inner wall, an outer wall, and an upper hot melt engaging section. A closure flange mounts on the latter section with a suitable adhesive therebetween.

Johnson et al U.S. Pat. No. 3,892,351 has a membrane type closure sealed by a seam to the top rolled-over edge of a round container. This, in turn is covered by an overcap with inner heat deforming ribs.

Edwards U.S. Pat. No. 4,787,530 discloses a container having a tamper-evident lid connected thereto by an inner airtight bead arrangement, with downward projections around the outer periphery of the container, and a continuous ring affixed to the downward projections.

A review of these prior art references discloses that none of them would be functional without their respective overcaps.

DISCLOSURE OF THE INVENTION

A general object of the invention is to provide an improved multi-piece flat top container for spoonable food products, which satisfies the requirements of the manufacturer, the producer, the consumer, and the realities of the market place.

Another object of the invention is to provide a multi-piece container including a thermoplastic coated paperboard body, a thermoplastic adapter ring mounted around and secured to the top edge thereof, and a tamper evident membrane sealed to the top surface of said adapter ring.

These and other objects and advantages of the invention will become more apparent when reference is made to the following drawings and accompanying description.

BEST MODE OF CARRYING OUT THE INVENTION

Figure 1:
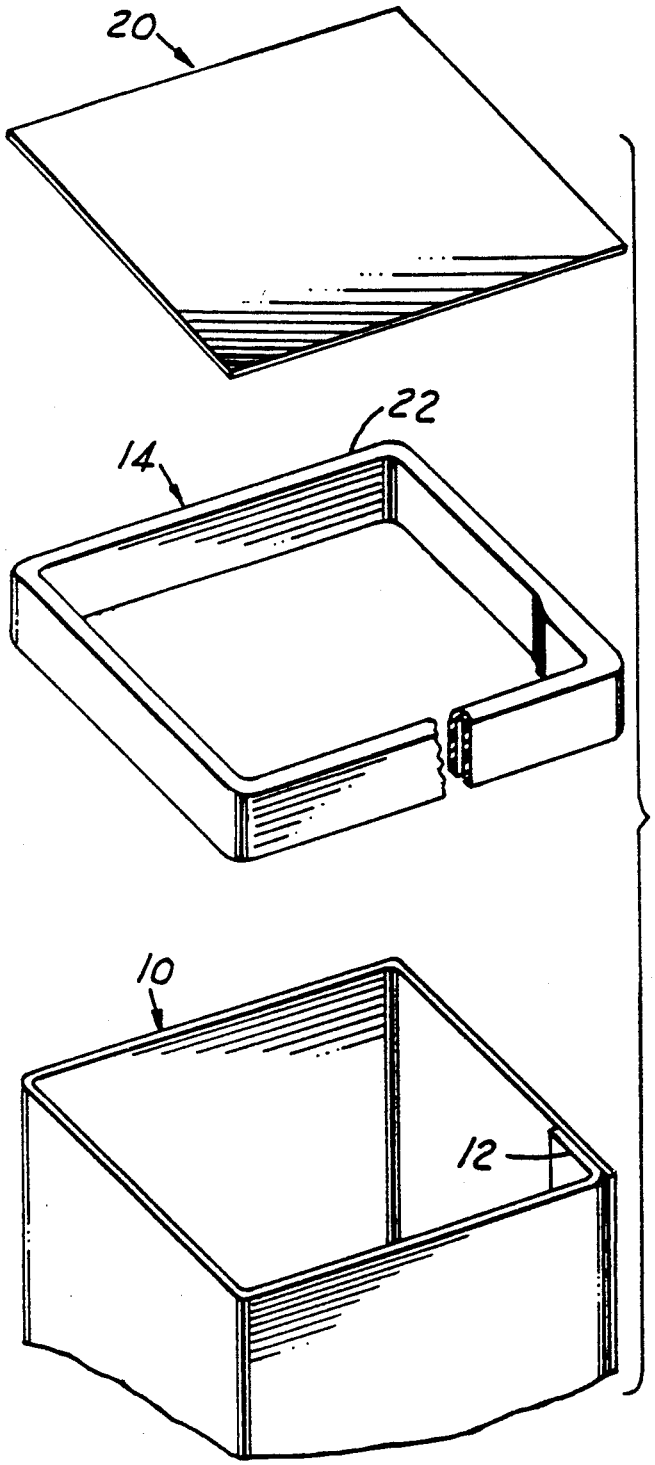
FIG. 1 is an exploded perspective view of the container embodying the invention.
Figure 1A:
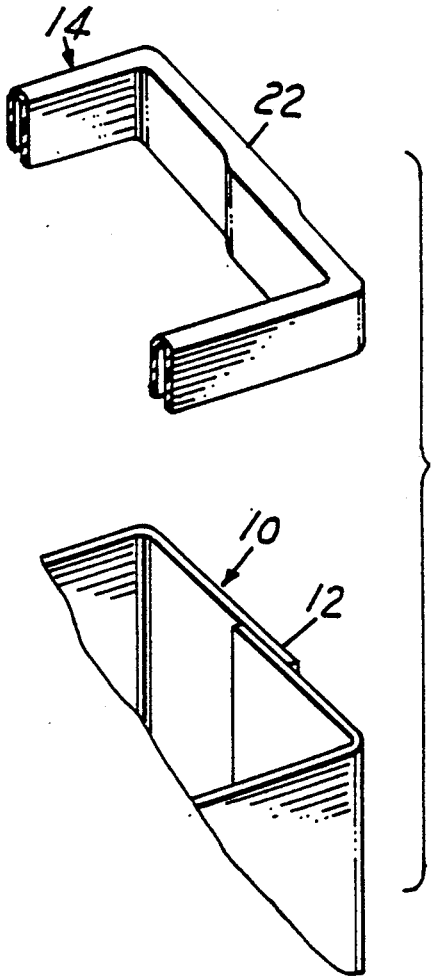
FIG. 1A is a fragmentary perspective view of an alternate arrangement of the side seam seal of the container.

Referring now to the drawings in greater detail, FIG. 1 illustrates a thermoplastic coated, square cross-section paperboard container body 10, with a side seam 12, which may be either a corner seam (FIG. 1), or a center seam (FIG. 1A).

Figure 3:
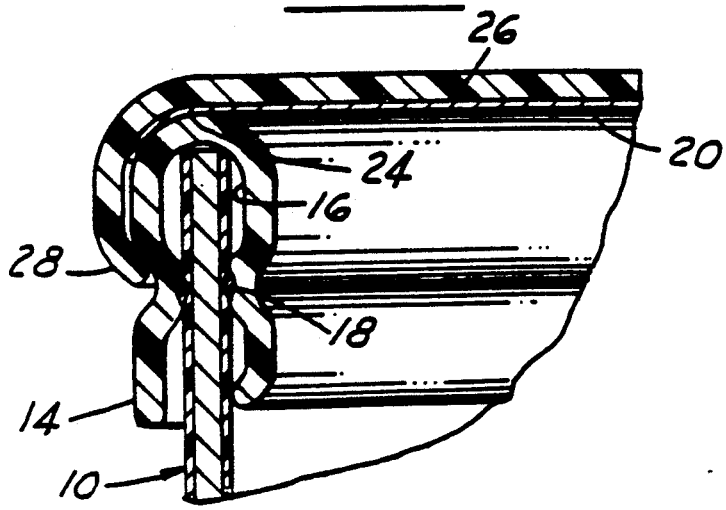
FIG. 3 is a cross-sectional view taken along the plane of the line 3—3 of FIG. 2, and looking in the direction of the arrows.

A thermo-formed or injection molded adapter ring 14 is formed to include an annular recess 16 (FIG. 3) adapted to mount over and sit upon the top edge of the body 10. The adapter ring is fusion sealed by a seal 18 at a mid height therearound to the confined outer and inner surfaces of the top edge. The recess 16 is wider at the location of the side seam 12, as is evident from FIGS. 1 and 1A.

A tamper evident membrane 20, comprising one of a suitable transparent film or paper, shaped to fit the area encompassed by the adapter ring 14, is mounted on the top edge 22 of the adapter ring and heat sealed thereto by a seal 24 (FIG. 3) by any suitable means, such as thermal, radio frequency, ultrasonic, electromagnetic, or microwave technologies.

Figure 2:
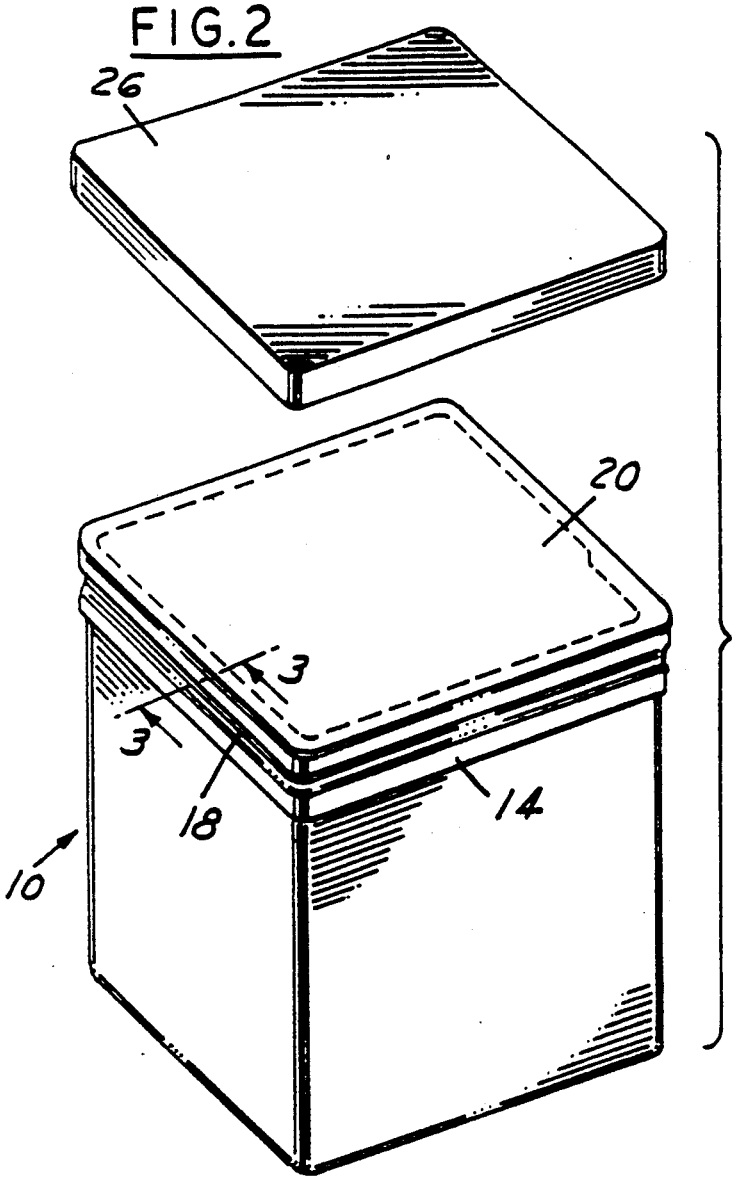
FIG. 2 is a perspective view of a closed container embodying the invention, and an optional overcap therefor.

A cover member or overcap 26 (FIG. 2) is optional, and may be formed of recycled material since it does not include a product contact surface. The overcap may include an inturned free edge 28 for cooperation with the peripheral area of the fusion seal 18. The overcap 26 may be used to provide mechanical protection for the membrane 20 during transportation, and to serve as a reclosure cover for the consumer. The overcap may be eliminated entirely in a multi-pack application where an overwrap provides a secondary protection.

Figure 4:
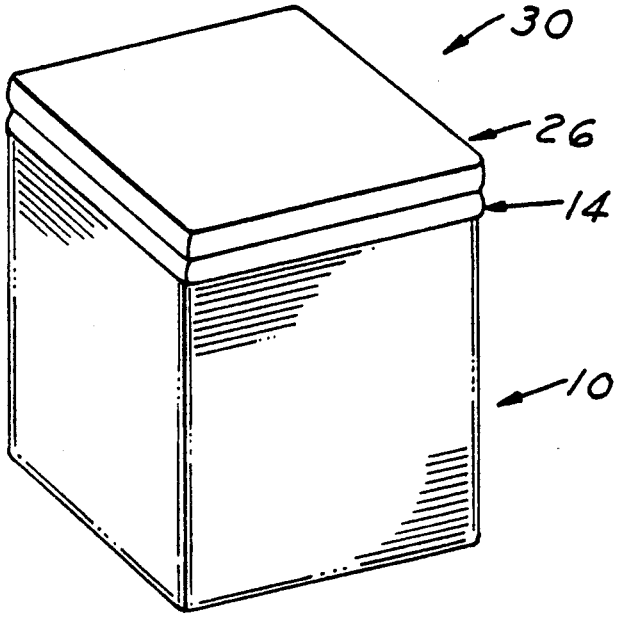
FIGS. 4 and 5 are alternative embodiments of the closed container.

As shown in FIG. 4, the container components 30 may incorporate a rectangular cross-section.

Figure 5:
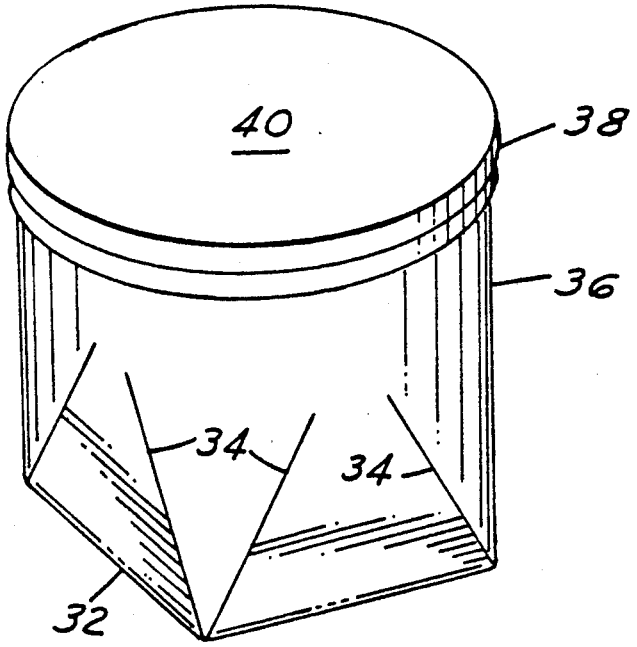

FIG. 5 illustrates a further container shape, namely a square bottom 32, with suitable fold lines 34 adapted to produce a round top 36, thereby requiring a round adapter ring 38, and a round membrane 40.

After being filled and sealed, the membrane 20 must be punctured or peeled off by the consumer in order to provide access to the spoonable food product within the container.

INDUSTRIAL APPLICABILITY

It should be apparent that the invention provides an improved flat top container for spoonable food products which should satisfy the critical and perceived needs of the manufacturer, the producer, the consumer, and the realities of the market place. Along with being completely satisfactory with respect to the just-recited needs, inasmuch as aluminum foil and hot melt adhesives are not required in the structure, it is more environmentally attractive.

While but three general embodiments of the invention have been shown and described, other modifications are possible within the scope of the following claims.

I claim:

1. A multi-piece container comprising a thermoplastic coated paperboard body of a predetermined cross-sectional configuration, a thermoplastic adapter ring of a predetermined height and having an annular recess formed therein adapted to mount over and sit upon the top edge portion of said body and having an annular seal formed therebetween at an intermediate height thereof, and a substantially flat membrane formed of any suitable material sealed adjacent its peripheral edge to the top edge of said adapter ring, wherein said thermoplastic coated paperboard body includes a side seam which is one of a corner seam or a center seam, and said recess of said adapter ring is formed to accommodate same.

2. The multi-piece container described in claim 1, wherein said annular seal is effected around both the interior and exterior of said top edge portion of said body.

3. The multi-piece container described in claim 1, wherein said flat membrane is formed of one of a transparent film or paper.

4. The multi-piece container described in claim 1, wherein said cross-sectional configuration of said body is one of a square, rectangle, or combination of square at the bottom and round at the top configuration.

5. The multi-piece container described in claim 1, and an optional overcap adapted to mount over said membrane and said adapter ring without being sealed thereto.

6. The multi-piece container described in claim 5, and an inturned free edge formed on said overcap for retention cooperation with a mid-portion of the height of said annular ring.

* * * * *